US009287654B2

(12) United States Patent
Takaki

(10) Patent No.: US 9,287,654 B2
(45) Date of Patent: Mar. 15, 2016

(54) ELECTRIC CONNECTOR

(71) Applicant: IRISO ELECTRONICS CO., LTD., Kanagawa (JP)

(72) Inventor: Masato Takaki, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 14/323,074

(22) Filed: Jul. 3, 2014

(65) Prior Publication Data

US 2015/0031233 A1 Jan. 29, 2015

(30) Foreign Application Priority Data

Jul. 24, 2013 (JP) ..... 2013-153942

(51) Int. Cl.

| | |
|---|---|
| ***H01R 24/00*** | (2011.01) |
| ***H01R 13/52*** | (2006.01) |
| ***H01R 12/71*** | (2011.01) |
| ***H01R 12/73*** | (2011.01) |
| ***H01R 13/11*** | (2006.01) |
| ***H01R 13/629*** | (2006.01) |

(52) U.S. Cl.

CPC ..... *H01R 13/52* (2013.01); *H01R 12/716* (2013.01); *H01R 12/737* (2013.01); *H01R 13/113* (2013.01); *H01R 13/629* (2013.01)

(58) Field of Classification Search

USPC ..... 439/74, 248, 637

IPC ..... H01R 23/725,23/6886, 23/7068, 23/6873, H01R 9/096, 12/57, 13/41, 13/26

See application file for complete search history.

(56) References Cited

U.S. PATENT DOCUMENTS 6,634,911 B1 * 10/2003 Billman et al. ..... 439/884
7,354,279 B2 * 4/2008 Uesaka ..... 439/74

(Continued)

FOREIGN PATENT DOCUMENTS

EP 2442405 A1 4/2012
JP 11-185827 A 7/1999

(Continued)

OTHER PUBLICATIONS

Office Action from Japanese Patent App. No. 2013-153942 mailed Aug. 30, 2013 with English language translation thereof.

(Continued)

*Primary Examiner* — Hien Vu

(74) *Attorney, Agent, or Firm* — Cermak Nakajima & McGowan LLP; Tomoko Nakajima

(57) ABSTRACT

A connector terminal includes a front contact-point portion that wipes off foreign material by slidingly contacting a plug terminal and a rear contact-point portion that is conductively connected with the plug terminal. The front contact-point portion has a sliding edge that slidingly contacts the plug terminal. The rear contact-point portion includes a contact edge that is thinner than the sliding edge, has a sliding width that is less than that of the sliding edge, and is conductively connected with the plug terminal by passing a sliding path of the sliding edge. Therefore, it becomes less likely for the contact edge to contact foreign material adhered to a portion other than portions at the sliding path. Thus, conduction failure can be prevented. In addition, by providing the connector terminal, it is possible to provide a socket that can similarly prevent conduction failure caused by foreign material.

6 Claims, 8 Drawing Sheets

(56) References Cited

U.S. PATENT DOCUMENTS

| | | | | |
|---|---|---|---|---|
| 7,637,783 | B2 * | 12/2009 | Sasaoka et al. | 439/637 |
| 8,672,713 | B2 * | 3/2014 | Tajiri et al. | 439/630 |
| 2012/0142226 | A1 * | 6/2012 | Funayama et al. | 439/692 |

FOREIGN PATENT DOCUMENTS

| | | | |
|---|---|---|---|
| JP | 2000-299150 | A | 10/2000 |
| JP | 3117439 | B1 | 10/2000 |
| JP | 2001-023711 | A | 1/2001 |
| JP | 2012-009345 | A | 1/2012 |
| JP | 2012-069243 | A | 4/2012 |
| WO | WO2009/082490 | A1 | 7/2009 |

OTHER PUBLICATIONS

European Search Report for European Patent App. No. 14175941.5 (Dec. 4, 2014).

* cited by examiner

ELECTRIC CONNECTOR

BACKGROUND OF THE INVENTION

1. Field of the Invention

The present invention relates to a connector terminal including a contact-point portion that wipes off foreign material and a contact-point portion that is conductively connected with a mating connector terminal, and to an electric connector including the connector terminal.

2. Description of the Related Art

Foreign materials, such as substrate scrap and dust, are sometimes adhered to a terminal surface of a mating connector terminal with which a connector terminal is conductively connected. When such foreign materials enter a location between the terminal surface of the mating connector terminal and a contact-point portion of the connector terminal, conductive connection between the connector terminals may become unstable. To overcome this problem, a connector terminal including two contact-point portions for contact with the terminal surface of the mating connector terminal is used, with one of the contact-point portions being used for wiping off such foreign materials and the other contact-point portion being conductively connected with the terminal surface of the mating connector terminal. In this connector terminal, the two contact-point portions are provided in a direction in which this connector terminal is fitted to the mating connector terminal, and slidingly contact in succession the mating connector terminal. When the contact-point portion that contacts the mating connector terminal earlier (front contact-point portion) wipes off such foreign materials, and the other contact-point portion (rear contact-point portion) successively contacts the terminal surface of the mating connector terminal from which such foreign materials have been wiped off, it is possible to prevent unstable conductive connection caused by entry of such foreign materials into a location between a contact portion and the terminal surface of the mating connector terminal (Japanese Unexamined Patent Application Publication No. 2012-69243).

When the plate thickness of the front contact-point portion and the plate thickness of the rear contact-point portion are the same, the rear contact-point portion may contact foreign material that has not been wiped off.

Specific examples in which such a situation occurs include a case in which foreign material adhered to a portion near a sliding path of the front contact-point portion and not completely wiped off by the front contact-point portion exists, and a case in which a mating connector terminal is inserted into a connector terminal in an obliquely tilted state instead of in a straight state with respect to a normal fitting direction.

Another example in which such a situation occurs is a case in which the front contact-point portion and the rear contact-point portion are warped in a plate thickness direction as a result of, when a connector terminal is an extraction terminal, contact with another member or a pressing operating during punching of a metallic plate. Here, the rear contact-point portion may contact a portion other than portions at the sliding path of the front contact-point portion, this portion being where foreign material has not been wiped off. As a result, conductive connection with a terminal surface of a mating connector terminal may become unstable when the rear contact-point portion moves onto the foreign material.

SUMMARY OF THE INVENTION

Accordingly, the present invention is carried out to make it possible to overcome the aforementioned problems. That is, it is an object of the present invention to make it possible to provide stable conductive connection with a terminal surface of a mating connector terminal as a result of restricting contact of a rear contact-point portion with foreign material in an electric connector including a connector terminal that includes a front contact-point portion and the rear contact-point portion. The front contact-point portion wipes off foreign material adhered to the terminal surface of the mating connector terminal. The rear contact-point portion is conductively connected with the terminal surface of the mating connector terminal. These contact-point portions slidingly contact in succession the terminal surface of the mating connector terminal.

To this end, the present invention provides the following structures.

According to an aspect of the present invention, there is provided a connector terminal including a contact portion that is conductively connected with a mating connector terminal and an elastic portion that elastically supports the contact portion, the mating connector terminal serving as a connection object. The contact portion includes a front contact-point portion and a rear contact-point portion that successively contact a planar terminal surface of the mating connector terminal in a fitting direction. The front contact-point portion is provided with a sliding edge that wipes off foreign material adhered to the terminal surface by slidingly contacting the mating connector terminal. The rear contact-point portion is provided with a contact edge that is thinner than the sliding edge of the front contact-point portion and that has a sliding width that is less than that of the sliding edge of the front contact-point portion. The contact edge passes a sliding path of the sliding edge and is conductively connected with the mating connector terminal.

The sliding edge of the front contact-point portion wipes off foreign material adhered to the terminal surface of the mating connector terminal, and the contact edge of the rear contact-point portion passes the sliding path of the sliding edge. Therefore, it is possible for the contact edge to conductively connect with the terminal surface where foreign material has been wiped off by the sliding edge.

The contact edge of the rear contact-point portion is narrower than the sliding width of the sliding edge of the front contact-point portion. Therefore, it is less likely for the contact edge to contact foreign material adhered to a location situated close to the sliding path of the sliding edge. In addition, even if the front contact-point portion and the rear contact-point portion are warped, it is less likely for the contact edge of the rear contact-point portion to contact a portion other than portions at the sliding path of the sliding edge of the front contact-point portion. Therefore, it is possible to restrict contact of the contact edge with foreign material, so that stable conductive connection with the terminal surface of the mating connector terminal can be achieved.

That is, although the present invention is useful in preventing displacement occurring between the front contact-point portion and the rear contact-point portion in the plate-thickness direction of the connector terminal when the connector terminal is warped, it is also useful when the front terminal and the rear terminal are not displaced from each other and plate-thickness centers are aligned. Although the front contact-point portion is used to wipe off foreign material, the front contact-point portion may be used for conductive connection with the mating connector terminal.

According to another aspect of the present invention, a rear contact-point portion includes a thin-walled portion whose plate thickness is less than that of the elastic portion, and the contact edge may be provided at the thin-walled portion.

When the rear contact-point portion is provided with a thin-walled portion, the rear contact-point portion tends to avoid a large foreign material, such as a tall foreign material. Therefore, it is possible for the rear contact-point portion to stably conductively connect with the terminal surface of the mating connector terminal.

The contact edge according to the present invention may be provided so that its plate-thickness center is substantially aligned with a plate-thickness center of the sliding edge.

For example, when the plate-thickness center of the contact edge is displaced from the plate-thickness center of the sliding edge in the width direction, the contact edge of the rear contact-point portion tends to contact a location other than locations at the sliding path of the sliding edge of the front contact-point portion. In this case, the contact edge contacts portions where foreign material has not been wiped off by the sliding edge. Therefore, conductive connection with the mating connector terminal may become unstable due to contact of the contact edge with the foreign material.

In the present invention, by causing the plate-thickness center of the contact edge to be substantially aligned with the plate-thickness center of the sliding edge, it is possible to restrict contact of the contact edge of the rear contact-point portion with a location other than locations at the sliding path of the sliding edge of the front contact-point portion.

The connector terminal may include a front terminal and a rear terminal that are integrated to each other. The front terminal includes an elastic portion and a contact portion provided with the front contact-point portion. The rear terminal includes an elastic portion and a contact portion provided with the rear contact-point portion.

By providing a connector terminal in which the front contact-point portion and the rear contact-point portion are provided at different terminals, that is, at the front terminal and the rear terminal, respectively, and are integrated to each other, even if one of the terminals contacts foreign material or the terminal surface of the mating connector terminal, it is possible to displace the one of the terminals independently of the other terminal. Consequently, it is possible to prevent the front terminal and the rear terminal from being influenced by contact pressure.

In the connector terminal including the elastic portion and the contact portion including the front contact-point portion and the rear contact-point portion, the front contact-point portion and the rear contact-point portion may be integrated to each other.

The front contact-point portion and the rear contact-point portion are provided at the same contact portion. Therefore, compared to a case in which a plurality of contact portions are provided and the front contact-point portion and the rear contact-point portion are provided at different contact portions, it is possible to suppress warping occurring in only one of the contact portions. Consequently, it is possible to restrict contact of the contact edge of the rear contact-point portion with a location other than locations at the sliding path of the sliding edge of the front contact-point portion.

The present invention may provide an electric connector including any one of the connector terminals according to the present invention.

This electric connector provides the operations/advantages of any one of the connector terminals that it includes.

According to the present invention, it is possible to restrict contact of the contact edge of the rear contact-point portion with foreign material in a connector terminal including contact-point portions that slidingly contact in succession the terminal surface of the mating connector terminal, with one of the contact-point portions wiping off foreign material adhered to the terminal surface of the mating connector terminal and the other contact-point portion being conductively connected with the terminal surface of the mating connector terminal. Therefore, it is possible to stably conductively connect the terminal surface and the contact edge of the rear contact-point portion at a portion where foreign material has been wiped off. Consequently, it is possible to prevent conduction failure when connecting connector terminals that are mounted on a circuit board.

DESCRIPTION OF THE PREFERRED EMBODIMENTS

Figure 1:
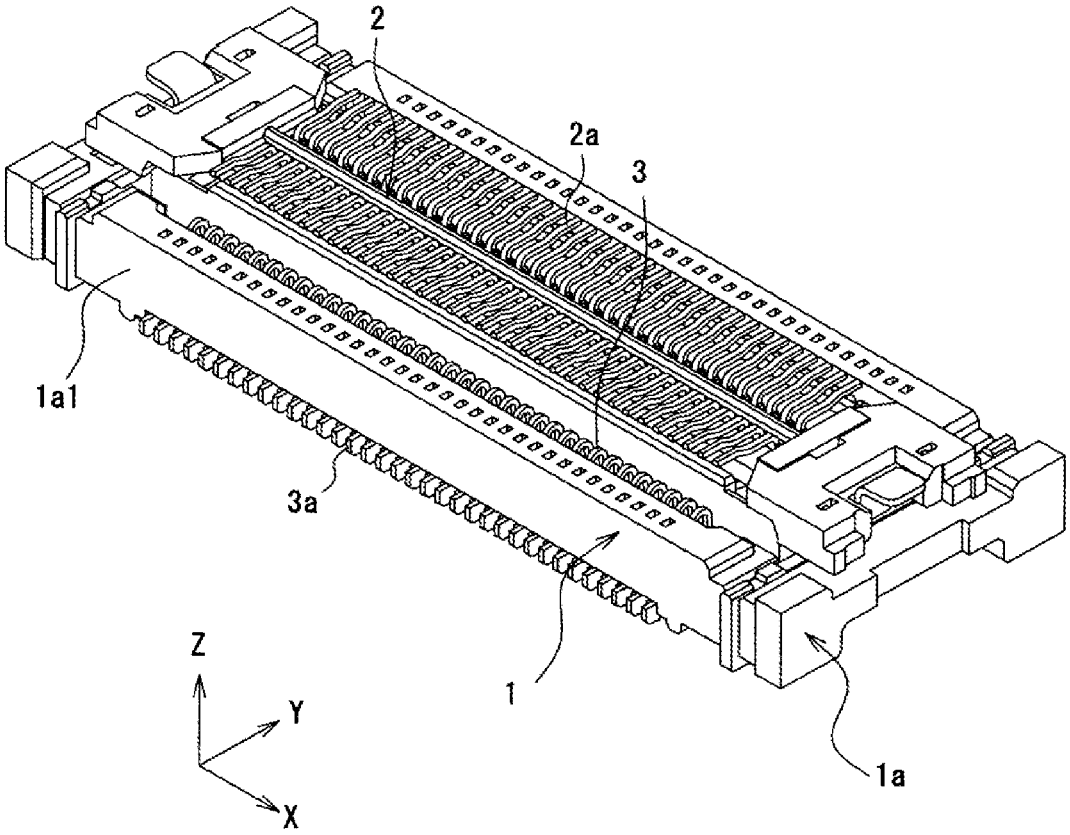
FIG. 1 is a perspective view of an electric connector including a connector terminal according to a first embodiment.

Preferred embodiments of the present invention are hereunder described with reference to the drawings. Common structural portions in the following embodiments are given the same reference numerals, and the same descriptions thereof are not repeated.

First Embodiment (FIGS. 1 to 6)

As shown in FIG. 1, a socket 1, serving as an electric connector according to the present invention, includes a substantially rectangular parallelepiped socket housing 1*a* and connector terminals 3 accommodated in the socket housing 1*a* and conductively connected with a plug terminal 2*a*, serving as a mating connector terminal. The plug terminal 2*a* is mounted to a plug 2, serving as a mating connector.

Socket Housing

Figure 2:
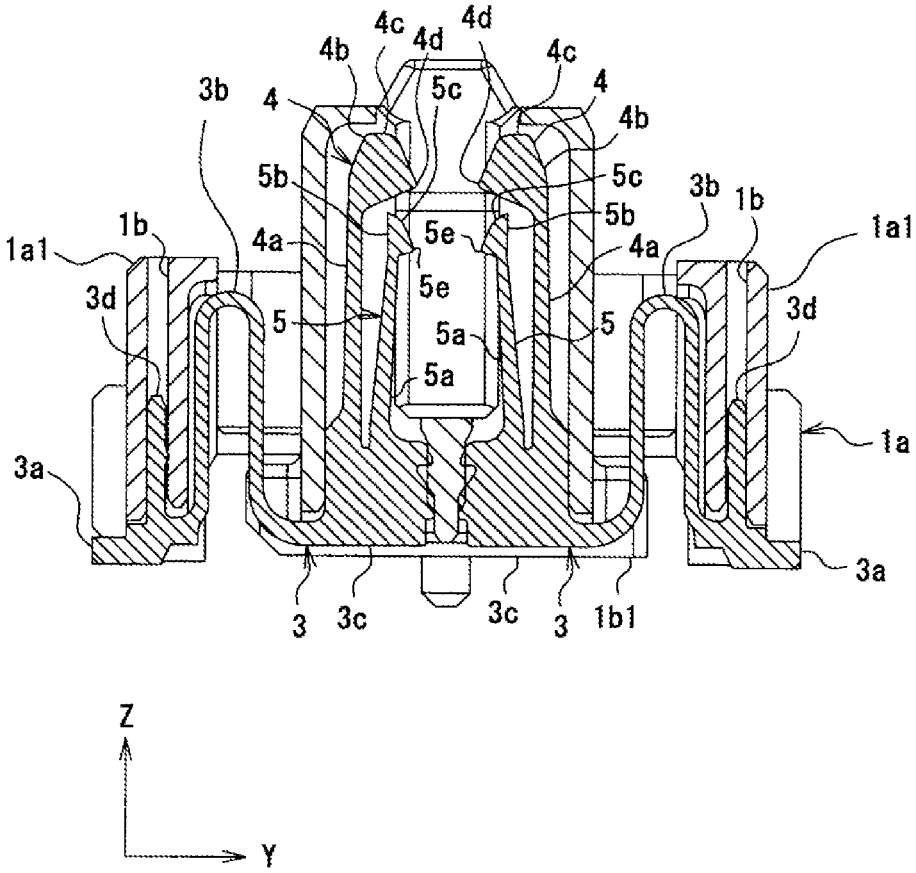
FIG. 2 is a sectional view of the connector terminal and the electric connector shown in FIG. 1.

The socket housing 1*a* is formed of insulating resin. As shown in FIGS. 1 and 2, the socket housing 1*a* has a floating structure including a stationary housing 1*a*1 and a movable housing 1*a*2 that is displaced relative to the stationary housing 1*a*1. Accommodation holes 1*b* for securing each connector terminal 3 are provided at both ends of the stationary housing 1*a*1 in a short-side direction. The accommodation holes 1*b* are provided at equal intervals in a longitudinal direction of the socket housing 1*a*. The connector terminals 3 are secured to the accommodation holes 1*b* at equal intervals in the longitudinal direction of the socket housing 1*a*. In the specification, as a matter of convenience, in the socket 1 shown in FIG. 1, the longitudinal direction corresponds to a direction X, the short-side direction corresponds to a direction Y, and a direction in which the plug terminal 2*a* and the connector terminals 3 are fitted to each other corresponds to a direction Z.

Connector Terminals

Figure 3:
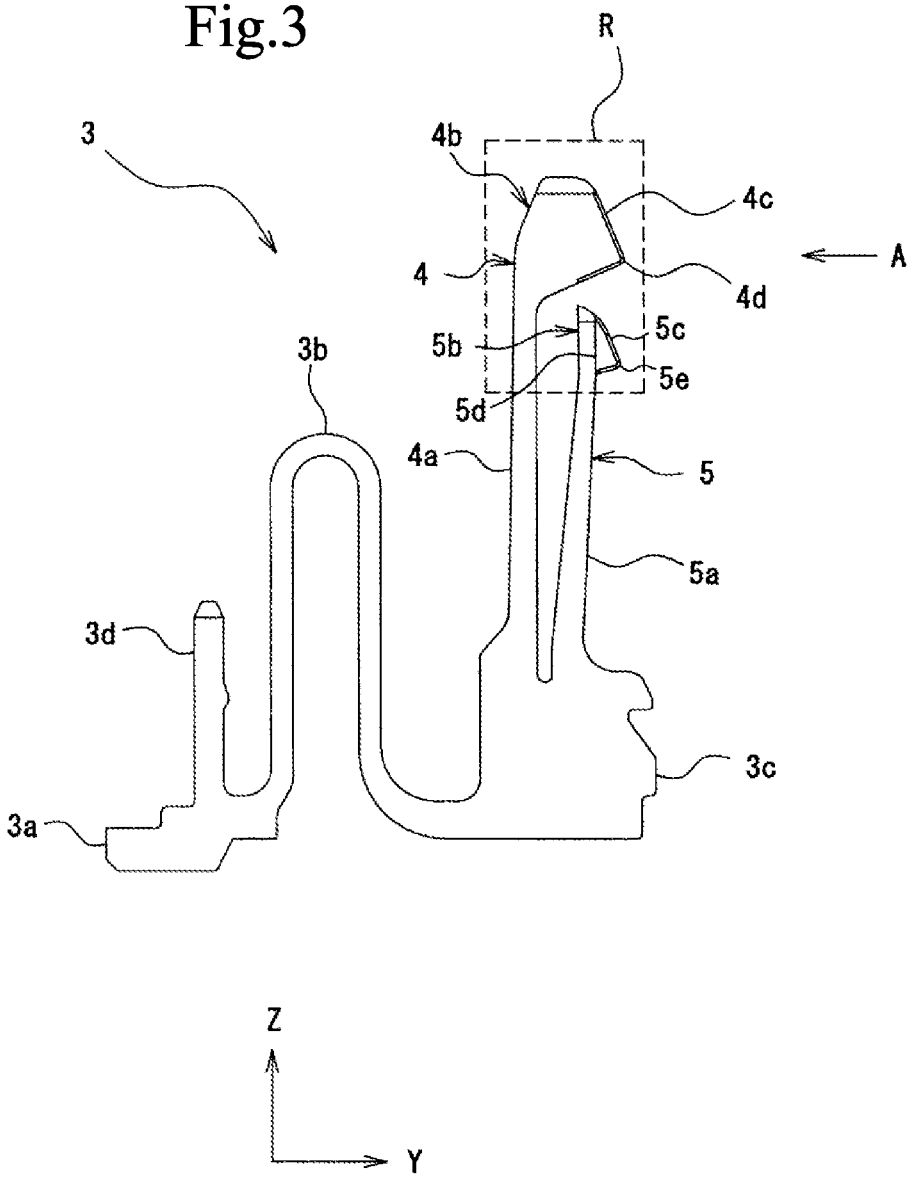
FIG. 3 is a front view of the connector terminal shown in FIG. 2.

The connector terminals 3 are extraction terminals formed by punching a conductive metallic plate by a pressing operation. As shown in FIGS. 2 and 3, each connector terminal 3 includes a substrate connection portion 3*a* that is connected to a circuit board (not shown), a substantially inverted U-shaped movable portion 3*b*, a base portion 3*c* that is provided adjacent to the movable portion 3*b*, a front terminal 4 that extends from the base portion 3*c*, and a rear terminal 5 that extends from the base portion 3*c* similarly to the front terminal 4. Each connector terminal 3 is formed so that plate thicknesses of portions other than a contact edge 5*e* and a thin-walled portion 5*d* (described later) are substantially the same.

Each securing portion 3*d* that is secured to the stationary housing 1*a*1 extends upward (towards the plug 2 in the direction Z) from the substrate connection portion 3*a* of its corresponding connector terminal 3. The connector terminals 3 are secured by press-fitting the securing portions 3*d* to the accommodation holes 1*b* of the housing 1*a*1. Each connector terminal 3 is provided so that its plate surface is parallel to the short-side direction of the socket housing 1*a*. The connector terminals 3 are mounted in pairs so as to oppose each other in the movable housing 1*a*2.

Each substantially inverted U-shaped movable portion 3*b* is capable of being deformed by spring elasticity. Therefore, since the displacement of each connector terminal 3 can be absorbed by deforming the movable portion 3*b* when, for example, pressing the movable portion 3*b* from a terminal surface of the plug terminal 2*a*, it is possible to maintain a state in which the front terminal 4 and the rear terminal 5 are in contact with the terminal surface of the plug terminal 2*a*.

Front Terminals

Each front terminal 4 includes an elastic portion 4*a* that is connected to the base portion 3*c* and a contact portion 4*b* that is provided at an end of the elastic portion 4*a*. Each contact portion 4*b* is provided with a front contact-point portion 4*c* that protrudes in a chevron form in a direction in which the contact portion 4*b* contacts the plug terminal 2*a*. An end surface of each front contact-point portion 4*c* is provided with a sliding edge 4*d* that slidingly contacts the terminal surface of the plug terminal 2*a*.

Rear Terminals

Figure 4:
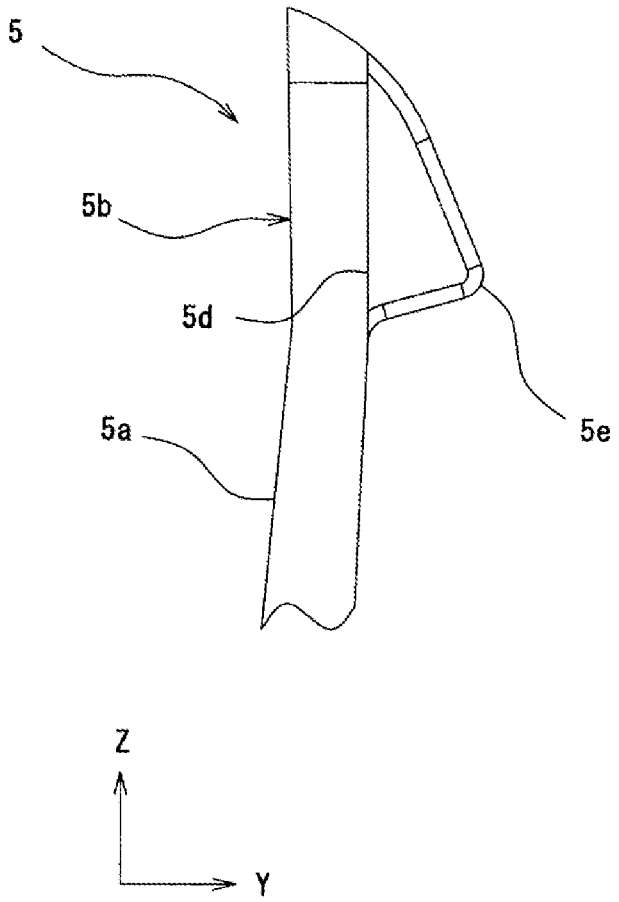
FIG. 4 is a partial enlarged view of a rear contact-point portion shown in FIG. 2.

As shown in FIG. 4, each rear terminal 5 includes an elastic portion 5*a* that is connected to the base portion 3*c* and a contact portion 5*b* that is provided at an end of the elastic portion 5*a*. Each contact portion 5*b* is provided with a rear contact-point portion 5*c* that protrudes in a chevron form in the direction in which the contact portion 5*b* contacts the plug terminal 2*a*. Each rear contact-point portion 5*c* is provided below its corresponding front contact-point portion 4*c* (that is, at a side of the socket 1 in the direction Z). Each rear contact-point portion 5*c* is provided with a substantially triangular thin-walled portion 5*d* that is disposed at the side of the plug terminal 2*a* and that is thinner than the elastic portion 5*a*. An end surface of each thin-walled portion 5*d* is provided with a contact edge 5*e* that contacts the terminal surface of the plug 2. Each thin-walled portion 5*d* is formed by coining. In other words, it is possible to form each thin-walled portion 5*d* that is substantially triangular and that is thinner than its corresponding elastic portion 5*a* by crushing each rear contact-point portion 5*c* to a desired thickness using a press, and by shaping excess metal, which has been produced by the pressing, by an extraction operation.

Figure 5:
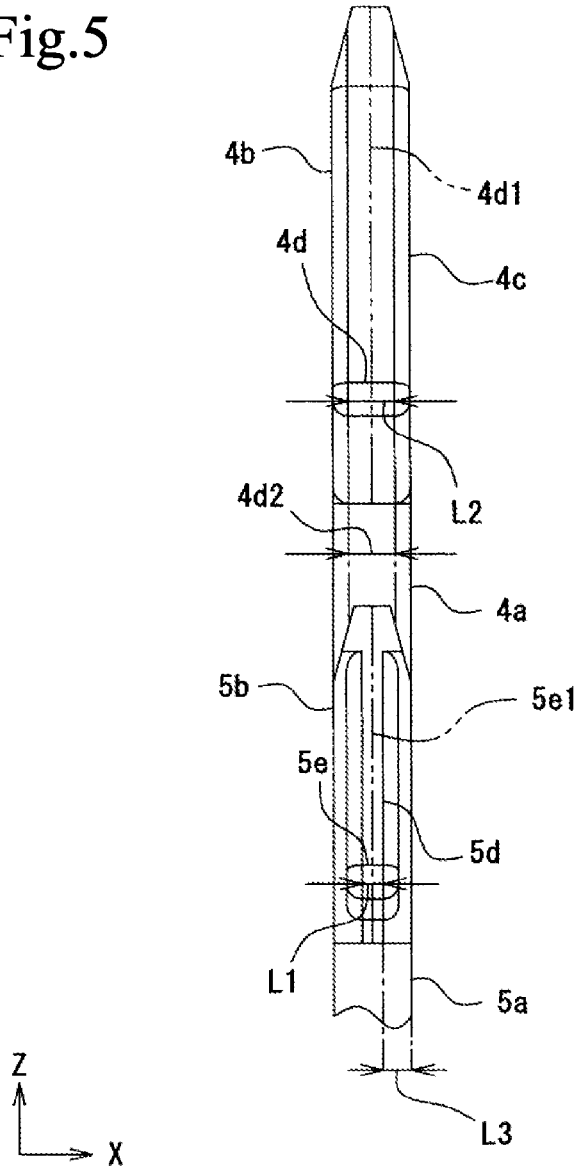
FIG. 5 is a partial enlarged view of a state of a portion R in FIG. 3 as seen from the direction of arrow A.
Figure 6:
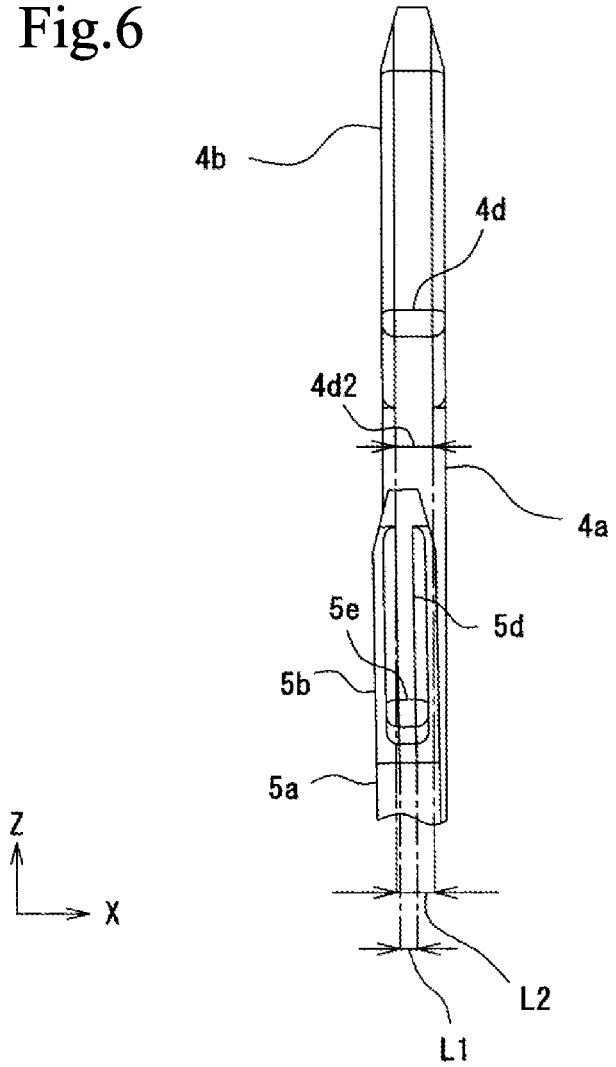
FIG. 6 is an explanatory view showing the connector terminal in which a rear terminal is warped, and corresponding to FIG. 5.

As shown in FIG. 5, a sliding width L1 of each contact edge 5*e* is set less than a sliding width L2 of the sliding edge 4*d* of each front terminal 4. In addition, a plate-thickness center 5*e*1 of the contact edge 5*e* of each rear contact-point portion 5*c* is substantially aligned with a plate-thickness center 4*d*1 of the sliding edge 4*d* of each front terminal 4.

Explanation of State of Use

Foreign materials, such as substrate scrap and dust, may be adhered to the terminal surface of the plug terminal 2*a*. When, in this state, each rear contact-point portion 5*c* comes into contact with the terminal surface, such foreign materials enter a location between the terminal surface and the contact edge 5*e* of each rear contact-point portion 5*c*. This may cause an unstable conductive connection between the contact edges 5*e* and the plug terminal 2*a*. However, as shown in FIGS. 3 and 5, when each front contact-point portion 4*c* is provided above its corresponding rear contact-point portion 5*c* (that is, at the side of the plug 2 in the direction Z), and the sliding edge 4*d* of each front contact-point portion 4*c* and the contact edge 5*e* of each rear contact-point portion are successively brought into sliding contact with the terminal surface of the plug terminal 2*a* when the plug 2 has been inserted into the socket 1, it is possible to wipe off such foreign materials adhered to the terminal surface by the sliding edge 4*d* of each front contact-point portion 4*c*. Then, when the contact edge 5*e* of each rear contact-point portion 5*c* is brought into contact with the terminal surface at a sliding path 4*d*2 where such foreign materials have been wiped off, it is possible to achieve stable conductive connection between each contact edge 5*e* and the plug terminal 2*a*.

Figure 8:
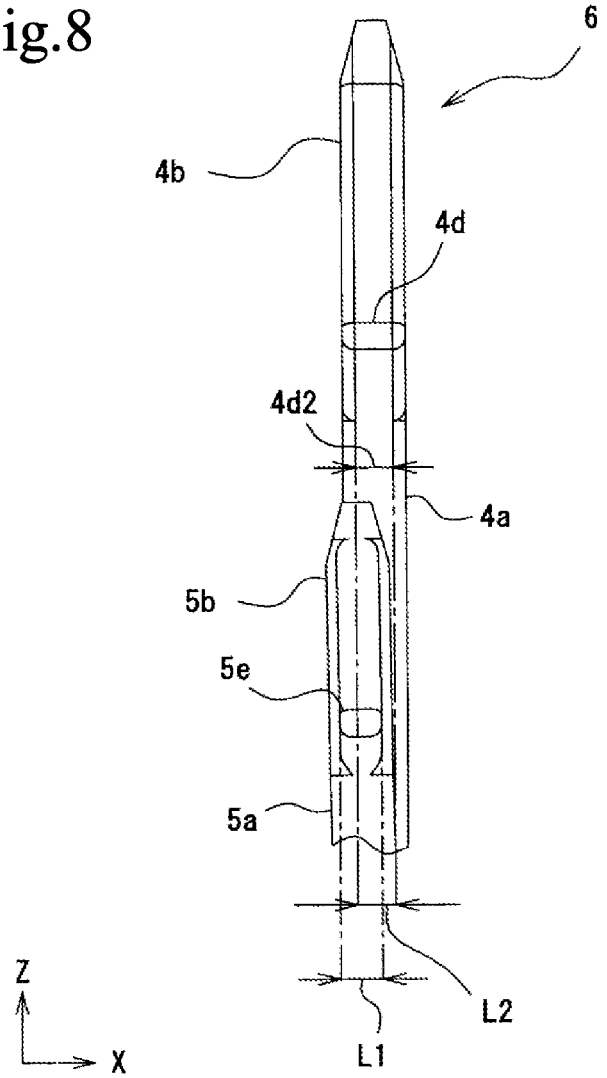
FIG. 8 is an explanatory view showing a state in which a rear terminal is warped in an existing connector terminal, and corresponding to FIG. 5.

As shown in FIG. 8, in a connector terminal 6 in which a sliding width L1 of a contact edge 5*e* in an existing rear contact-point portion 5*c* is the same as a sliding width L2 of a sliding edge 4*d* in a front contact-point portion 4*c*, the contact edge 5*e* tends to contact foreign material situated close to a sliding path 4*d*2 of the sliding edge 4*d* and adhered to a terminal surface of a plug terminal 2*a*. Particularly, for example, when a plug 2 is inserted into a socket 1 in an obliquely tilted state instead of in a straight state with respect to a normal fitting direction, or when, as shown in FIG. 8, the rear contact-point portion 5*c* and the front contact-point portion 4*c* are warped, the contact edge 5*e* may be displaced in a plate-thickness direction and contact a portion of the terminal surface that is displaced from the sliding path 4*d*2 of the sliding edge 4*d*. In these cases, the contact edge 5*e* may contact foreign material that has not been wiped off, as a result of which conductive connection between the contact edge 5*e* and the plug terminal 2*a* may become unstable.

In contrast, in each connector terminal 3 according to the present invention, since the sliding width L1 of each contact edge 5*e* is less than the sliding width L2 of each sliding edge 4*d*, even if foreign material is adhered to the terminal surface of the plug terminal 2*a* at a location that is close to the sliding path 4*d*2 of each sliding edge 4*d*, it is less likely for the contact edges 5*e* to contact the foreign material. In particular, for example, even if the plug 2 is inserted into the socket 1 in an obliquely tilted state instead of in a straight state with respect to the normal fitting direction, or even if the contact edges 5*e* are displaced in the plate-thickness direction of the corresponding connector terminals 3 due to warping of the rear contact-point portions 5*c* and the front contact-point portions 4*c*, it becomes less likely for the contact edges 5*e* to be displaced from the sliding paths 4*d*2 of the corresponding sliding edges 4*d*. Therefore, since it becomes less likely for the contact edges 5*e* to contact foreign material adhered to outer sides of the corresponding sliding paths 4*d*2, the contact edges 5*e* and the plug terminal 2*a* tend to be stably conductively connected with each other.

As shown in FIGS. 4 and 5, the rear contact-point portion 5*c* of each connector terminal 3 according to the present invention is provided with a thin-walled portion 5*d* that is thinner than the corresponding elastic portion 5*a*. Since it is possible for the rear contact-point portions 5*c* to avoid foreign material that is larger by an amount corresponding to a difference L3 between the thickness of each elastic portion 5*a* and the thickness of each thin-walled portion 5*d*, it is even less likely for the rear contact-point portions 5*c* to contact the foreign material.

As described above, when the socket 1 according to the present invention is used, it is possible to restrict contact of the contact edge 5*e* of each rear contact-point portion 5*c* with foreign material. Therefore, since it is possible for the terminal surface and the contact edges 5*e* of the corresponding rear contact-point portions 5*c* to be stably conductively connected with each other at a portion where the foreign material has been wiped off, it is possible to prevent conduction failure when connecting the plug terminal 2*a* and each connector terminal 3 mounted on a circuit board.

The socket 1 has a floating structure including a stationary housing 1*a*1 and a movable housing 1*a*2 that is capable of being displaced relative to the stationary housing 1*a*1. Therefore, when the plug 2 is inserted into the movable housing 1*a*2, the movable housing 1*a*2 is displaced and the plug terminal 2*a* tends to be obliquely inserted instead of being straightly inserted with respect to the normal fitting direction. Accordingly, by using such a socket 1, the connector terminals 3 according to the present invention are effective in achieving the purpose of stably conductively connecting the contact edges 5*e* with the plug terminal 2*a* as a result of restricting contact of foreign material with the contact edges 5*e*.

Figure 7:
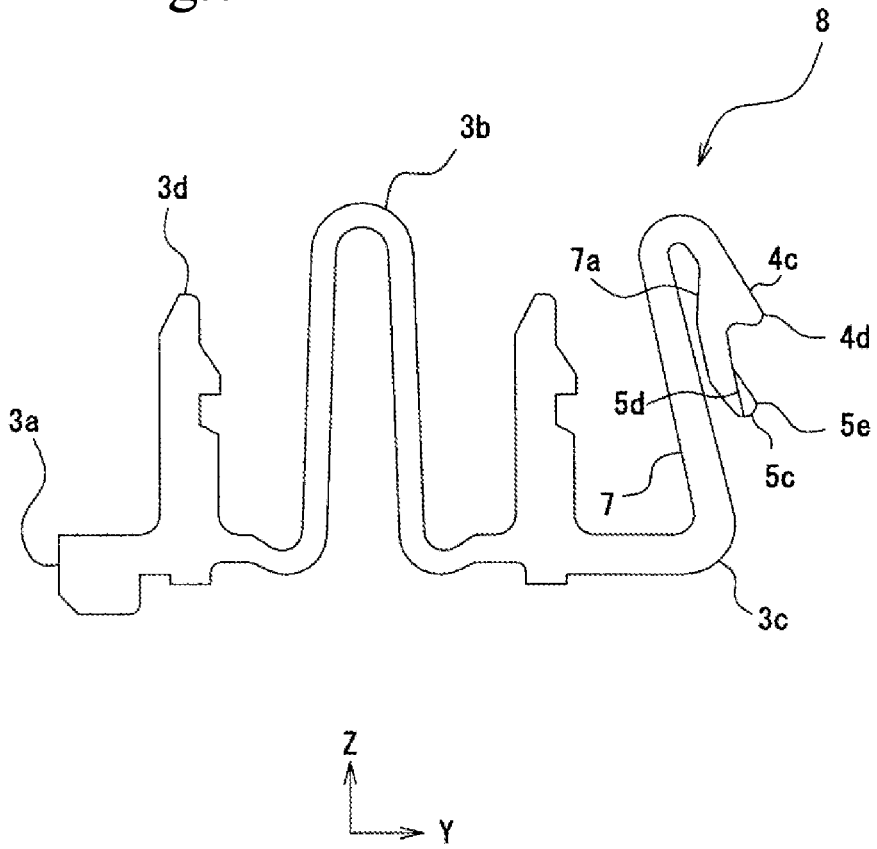
FIG. 7 is a side view of a connector terminal according to a second embodiment.

Second Embodiment (FIG. 7)

In the first embodiment, each connector terminal 3 includes a front terminal 4 and a rear terminal 5 that extend from the base portion 3*c* and that are provided with a front contact-point portion 4*c* and a rear contact-point portion 5*c* at their end sides, respectively. However, as shown in FIG. 7, instead of the connector terminals 3, it is possible to provide connector terminals 8 each including one elastic portion 7 that extends from a base portion 3 and that is provided with a contact portion 7*a* at an end side thereof. Each contact portion 7*a* includes a front contact-point portion 4*c* and a rear contact-point portion 5*c*.

Such connector terminals 8 make it possible to restrict separate displacement of the front contact-point portions 4*c* and the rear contact-point portions 5*c*. Therefore, displacements thereof resulting from warping of the front contact-point portions 4*c* and the rear contact-point portions 5*c* caused by, for example, contact with another member or a pressing operation are less likely to occur. Consequently, it is possible to provide connector terminals 8 that can prevent conduction failure caused by contact of contact edges 5*e* with foreign material by making it less likely for the contact edge 5*e* of each rear contact-point portion 5*c* to contact a portion other than portions at a sliding path 4*d*2 of a sliding edge 4*d* of the corresponding front contact-point portion 4*c*.

Modification of First and Second Embodiments

In each of the above-described embodiments, as an electric connector including connector terminals 3 or connector terminals 8, a socket 1 having a floating structure including a stationary housing 1*a*1 and a movable housing 1*a*2 is exemplified. However, the connector terminals 3 or the connector terminals 8 are applicable to a socket that does not have such a floating structure. Even in this case, it is possible to achieve stable conductive connection with the plug terminal 2*a* by making it less likely for the contact edges 5*e* of the rear contact-point portions 5*c* to contact foreign material.

What is claimed is:

1. An electric connector comprising:

a connector terminal including a contact portion that is conductively connected with a mating connector terminal of a mating connector and an elastic portion that elastically supports the contact portion, the mating connector terminal serving as a connection object, the contact portion being formed of a metallic plate, the contact portion including a front contact-point portion and a rear contact-point portion at a plate edge portion of the contact portion, the front contact-point portion and the rear contact-point portion being mutually independent of each other and successively contacting a planar terminal surface of the mating connector terminal in a fitting direction, wherein the front contact-point portion is provided with a sliding, the sliding edge wiping off foreign material adhered to the terminal surface by slidingly contacting the mating connector terminal up to a contact position where the electric connector and the mating connector are in a fitted state from when the sliding edge contacts the terminal surface of the mating connector terminal, and wherein the rear contact-point portion is provided with a triangular thin-walled portion and a contact edge of the rear contact-point portion is thinner than the front contact-point portion and a sliding width of the rear contact-point portion is narrower than that of the sliding edge of the front contact-point portion, the contact edge being formed of a plate edge of the metallic plate, and the contact edge being conductively connected with the mating connector terminal at a sliding path at the terminal surface where the foreign material has been wiped off by the sliding edge of the front contact-point portion thereby to provide a stable conductive connection.

2. The electric connector according to claim 1, wherein a plate-thickness center of the contact edge is substantially aligned with a plate-thickness center of the sliding edge.

3. The electric connector according to claim 1, wherein the connector terminal includes a front terminal and a rear terminal that are integrated to each other, the front terminal including an elastic portion and a contact portion provided with the front contact-point portion, the rear terminal including an elastic portion and a contact portion provided with the rear contact-point portion.

4. The electric connector according to claim 1, wherein the connector terminal includes the elastic portion and the contact portion including the front contact-point portion and the rear contact-point portion, wherein the front contact-point portion and the rear contact-point portion are integrated to each other.

5. The electric connector according to claim 1, wherein the thin-walled portion is a terminal portion that protrudes from the elastic portion towards the mating connector terminal.

6. The electric connector according to claim 1, wherein the thin-walled portion is a terminal portion formed by crushing the metallic plate so as to become thinner than the elastic portion.

* * * * *